US010306988B2

(12) United States Patent
Yang

(10) Patent No.: US 10,306,988 B2
(45) Date of Patent: Jun. 4, 2019

(54) MOON CHAIR

(71) Applicant: TOPSUN CREATIVE DESIGN, Hangzhou (CN)

(72) Inventor: Baoqing Yang, Hangzhou (CN)

(73) Assignee: Topsun Creative Design, Hangzhou (CN)

( * ) Notice: Subject to any disclaimer, the term of this patent is extended or adjusted under 35 U.S.C. 154(b) by 398 days.

(21) Appl. No.: 15/084,960

(22) Filed: Mar. 30, 2016

(65) Prior Publication Data

US 2016/0286963 A1 Oct. 6, 2016

(30) Foreign Application Priority Data

Apr. 1, 2015 (CN) ..... 2015 2 0194228 U

(51) Int. Cl.
*A47C 4/28* (2006.01)
*A47C 4/44* (2006.01)
*A47C 4/46* (2006.01)

(52) U.S. Cl.
CPC ..... *A47C 4/28* (2013.01); *A47C 4/44* (2013.01); *A47C 4/46* (2013.01)

(58) Field of Classification Search
CPC ..... A47C 4/28; A47C 4/44; A47C 4/46
USPC ..... 297/19, 21, 22, 23, 39, 16.1, 46
See application file for complete search history.

(56) References Cited

U.S. PATENT DOCUMENTS 2,652,882 A * 9/1953 Kotler ..... A47C 4/40 297/188.04
3,989,295 A * 11/1976 Sparkes ..... A47C 4/44 280/651
RE31,760 E * 12/1984 Kassai ..... B62B 7/08 280/42
4,772,068 A * 9/1988 Gleckler ..... A47C 7/002 248/188.5
5,054,848 A * 10/1991 Liu ..... A47C 5/10 297/16.1
5,735,570 A * 4/1998 Tseng ..... A47C 4/20 297/35
6,213,545 B1 * 4/2001 Chun-Yueh ..... A47C 4/20 297/39
6,471,288 B2 * 10/2002 Alexander, Jr. ..... A47C 4/40 108/144.11
6,595,582 B1 * 7/2003 Liu ..... A47C 4/18 16/231
6,964,429 B2 * 11/2005 Suga ..... B62B 7/08 280/47.38

(Continued)

*Primary Examiner* — Syed A Islam
(74) *Attorney, Agent, or Firm* — Fitch, Even, Tabin & Flannery LLP

(57) ABSTRACT

A moon chair includes a seat rod, a front foot rod and a rear foot rod, a first supporting rod, a second supporting rod and a fixing member. The first supporting rod is articulated to the seat rod and the fixing member; the second supporting rod is articulated to the front foot rod and the fixing member; the fixing member is installed on the rear foot rod; and the fixing member has a first working state and a second working state. When the fixing member is in the first working state, the moon chair is in an unfolded state. When the fixing member is in the second working state, the moon chair is in a folded state. The moon chair can be unfolded or folded by switching the fixing member between the first working state and the second working state, which is very convenient.

20 Claims, 6 Drawing Sheets

(56) References Cited

U.S. PATENT DOCUMENTS

| | | | | |
|---|---|---|---|---|
| 7,086,694 | B1 * | 8/2006 | Huang | A47C 4/44<br>297/35 |
| 7,118,121 | B2 * | 10/2006 | Cheng | B62B 7/08<br>280/642 |
| 7,273,249 | B1 * | 9/2007 | Tseng | A47C 4/10<br>297/16.1 |

* cited by examiner

MOON CHAIR

The present application claims the benefit of priority to Chinese patent application No. 201520194228.9 titled "MOON CHAIR", filed with the Chinese State Intellectual Property Office on Apr. 1, 2015, the entire disclosure of which is incorporated herein by reference.

FIELD

The present application relates to the technical field of seats, in particular to a moon chair.

BACKGROUND

A moon chair is a leisure chair frequently used in the daily home life, and includes a chair frame and fabric. The fabric is fixed on the frame, and after a person seats on the fabric, the chair looks like a crescent when looking from one side, thus the chair is named as a moon chair. The chair frame of the moon chair includes a seat rod, a front foot rod and a rear foot rod. The front foot rod and the rear foot rod are used to support the seat rod and ensure the stability and height of the moon chair when it is unfolded.

In the conventional technology, the front foot rod and the rear foot rod of the moon chair are generally arranged crosswise and upper ends thereof are both fixed on the seat rod. When the chair is unfolded or folded, the front foot rod and the rear foot rod crosswise slide with respect to each other. In some moon chairs, the foot rods are further provided with hanger positioning elements, and an opening angle between the front foot rod and the rear foot rod can be chosen by coupling grooves of the hangers with the hanger positioning elements of the foot rod, to allow the seat rod of the moon chair to be arranged at different inclination angles and heights. However, for the moon chair with the above structure, it is required to position the hangers when the moon chair is to be unfolded and to press the hangers to unlock the hangers when the moon chair is to be folded, and the tubes are dispersed and not fixed after the moon chair is folded, therefore it is inconvenient to use the moon chair and the operation is complicated.

SUMMARY

For addressing the issue that the moon chair of a crossed structure in the conventional technology is inconvenient to use, a new moon chair is provided according to the present application.

The moon chair according to the present application includes a seat rod, a front foot rod and a rear foot rod, and the front foot rod and the rear foot rod are respectively articulated to the seat rod. The moon chair further includes a first supporting rod, a second supporting rod and a fixing member. The first supporting rod is respectively articulated to the seat rod and the fixing member. The second supporting rod is respectively articulated to the front foot rod and the fixing member. The fixing member is installed on the rear foot rod. The fixing member has a first working state and a second working state. In the case that the fixing member is in the first working state, the moon chair is in an unfolded state; and in the case that the fixing member is in the second working state, the moon chair is in a folded state.

The first supporting rod is connected to the seat rod and the fixing member on the rear foot rod, to form a stable triangular supporting structure. The second supporting rod is connected to the front foot rod and the fixing member on the rear foot rod, to form a stable triangular supporting structure. The moon chair can be unfolded or folded by switching the fixing member between the first working state and the second working state, which is very convenient. After the moon chair is folded, the fixing member is in the second working state, which ensures the stability of the folding state.

Preferably, the fixing member is a rotatable fixing member. The rotatable fixing member has one end articulated to the rear foot rod and another end articulated to the first supporting rod and the second supporting rod. One side of the rotatable fixing member is provided with a clamping groove. In the case that the rotatable fixing member is in the first working state and the moon chair is in the unfolded state, the clamping groove is configured to clamp the rear foot rod; and in the case that the rotatable fixing member is in the second working state and the moon chair is in the folded condition, the clamping groove is configured to clamp the seat rod.

With the rotatable fixing member, in the first working state, the first supporting rod is subjected to a force to allow the rotatable fixing member to tightly clamp the rear foot rod, and the second supporting rod ensures an opening angle between the front foot rod and the rear foot rod to keep constant, thereby ensuring the stability of the moon chair in the unfolded state. When it is required to fold the moon chair, the rotatable fixing member can be switched to the second working state from the first working state by pushing the second supporting rod, to allow the clamping groove to clamp the seat rod, therefore it is very convenient to fold the moon chair.

The rotatable fixing member is articulated to the rear foot rod by a first articulated shaft. The rotatable fixing member is articulated to the first supporting rod by a second articulated shaft. The first supporting rod is articulated to the seat rod by a third articulated shaft. The second articulated shaft is located in a connecting line connecting the first articulated shaft and the third articulated shaft at a side close to the front foot rod, or the second articulated shaft is located in the connecting line.

Since the second articulated shaft is located in the connecting line connecting the first articulated shaft and the third articulated shaft at a side close to the front foot rod, or the second articulated shaft is located in the connecting line, the pressure may be transferred from the first supporting rod to the rotatable fixing member, to allow the rotatable fixing member to tightly press against the rear foot rod.

Preferably, the fixing member is a rotatable fixing member; the rotatable fixing member has a first end articulated to the rear foot rod by a first articulated shaft and a second end articulated to the first supporting rod and the second supporting rod via a drum-shaped stopper. In the case that the rotatable fixing member is in the first working state and the moon chair is in the unfolded state, the drum-shaped stopper is configured to abut against the rear foot rod at a first position higher than the first articulated shaft; and in the case that the rotatable fixing member is in the second working state and the moon chair is in the folded condition, the drum-shaped stopper is configured to abut against the rear foot rod at a second position lower than the first articulated shaft.

Further, the drum-shaped stopper has a drum-shaped portion and a rod portion, the rod portion of the drum-shaped stopper is configured to pass through respective through holes in the second end of the rotatable fixing member, the first supporting rod and the second supporting rod, to allow the first supporting rod and the second supporting rod to be articulated to the rotatable fixing member; and the drum-shaped portion has a necked portion which is necked in the radial direction of the drum-shaped stopper and configured to cooperate with an outer surface of the rear foot rod.

Further, the first supporting rod is articulated to the seat rod by a second articulated shaft; and the drum-shaped stopper, by which the rotatable fixing member is articulated to the first supporting rod, is located in a connecting line connecting the first articulated shaft and the second articulated shaft at a side close to the front foot rod, or the drum-shaped stopper is located in the connecting line.

Further, a first seat-rod supporting tube and a second seat-rod supporting tube respectively configured to connect the front foot rod and the rear foot rod are symmetrically fixed below the seat rod at two sides of the seat rod, two ends of the first seat-rod supporting tube at a left side of the seat rod are fixed to the seat rod; and two ends of the second seat-rod supporting tube at a right side of the seat rod are fixed to the seat rod; the front foot rod is articulated to each of the first seat-rod supporting tube and the second seat-rod supporting tube at an inner side of the respective seat-rod supporting tube, and a first spacer is arranged between articulated ends of the front foot rod and the respective seat-rod supporting tube; the rear foot rod is articulated to each of the first seat-rod supporting tube and the second seat-rod supporting tube at an outer side of the respective seat-rod supporting tube, and a second spacer is arranged between articulated ends of the rear foot rod and the respective seat-rod supporting tube; and a third spacer is arranged between articulated ends of the first supporting rod and the second supporting rod.

The fixing member is a slidable fixing member. The slidable fixing member includes a main body and a pin. The main body is sleeved on the rear foot rod. The rear foot rod has a first fixing position and a second fixing position for fixing the slidable fixing member; and the main body is configured to be fixed at the first fixing position or the second fixing position by the pin.

In the case that the slidable fixing member is in the first working state and the moon chair is in the unfolded state, the main body is configured to be fixed at the first fixing position by the pin; and in the case that the slidable fixing member is in the second working state and the moon chair is in the folded condition, the main body is configured to be fixed at the second fixing position by the pin.

Preferably, the pin is a spring pin.

Preferably, the rear foot rod is provided with a plurality of the first fixing positions.

By using the pin to fix the slidable fixing member, the position of the moon chair is fixed by the pin when it is unfolded or folded, therefore the structure is stable and the operation is very convenient.

Preferably, the seat rod includes a first seat rod, a second seat rod and a seat rod reinforcement tube, and the first seat rod and the second seat rod are connected by the seat rod reinforcement tube.

The seat rod includes a foot rod connection strap, and the foot rod connection strap is articulated to the front foot rod and/or the rear foot rod.

Preferably, a bottom of the front foot rod and a bottom of the rear foot rod are each further provided with a foot sleeve.

Figure 1:
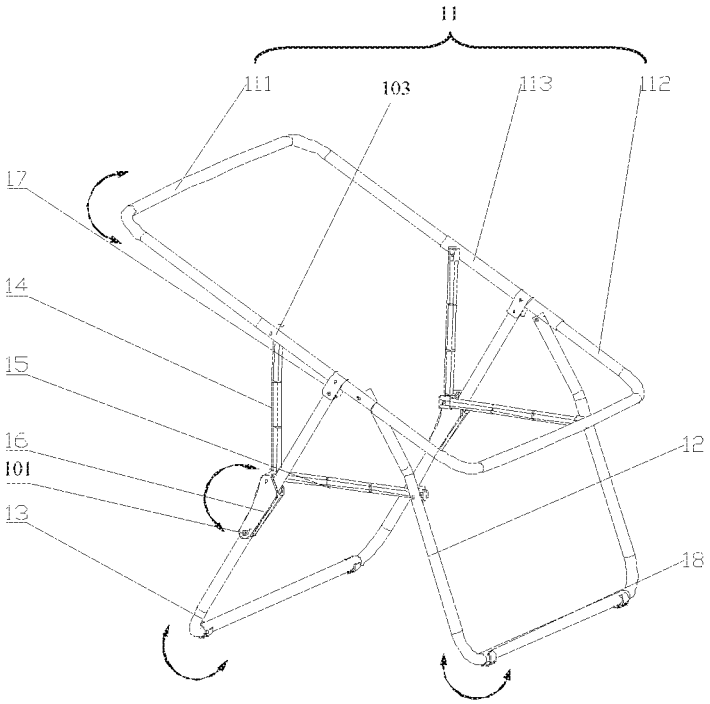
FIG. 1 is a schematic view showing a moon chair according to a first embodiment of the present application when the moon chair is unfolded.
Figure 2:
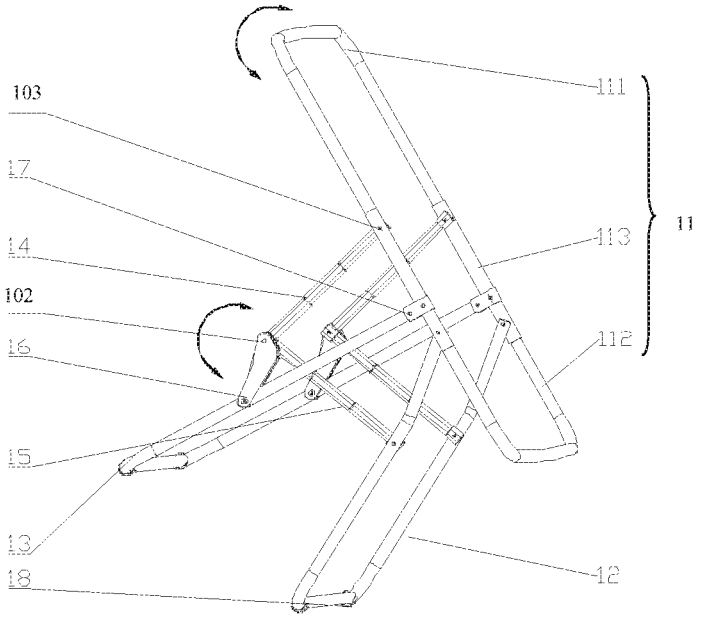
FIG. 2 is a schematic view showing the moon chair according to the first embodiment of the present application when the moon chair is partially folded.
Figure 3:
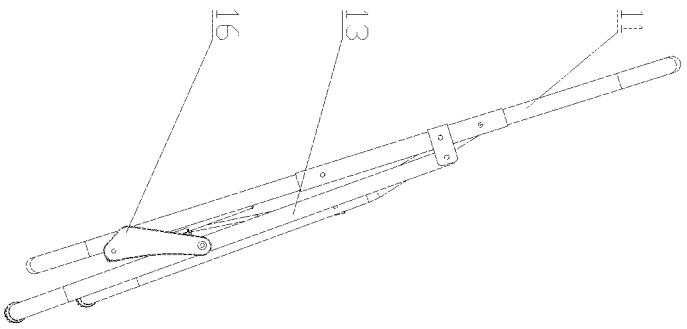
FIG. 3 is a schematic view showing the moon chair according to the first embodiment of the present application when the moon chair is completely folded.
Figure 4:
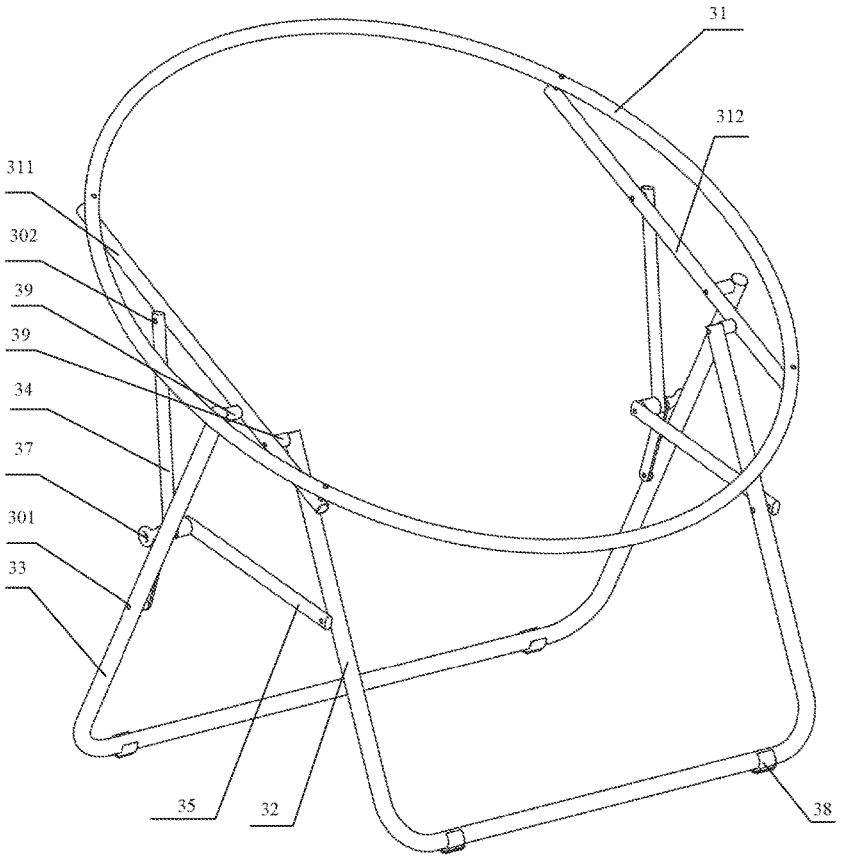
FIG. 4 is a schematic view showing a moon chair according to a second embodiment of the present application when the moon chair is unfolded.
Figure 5:
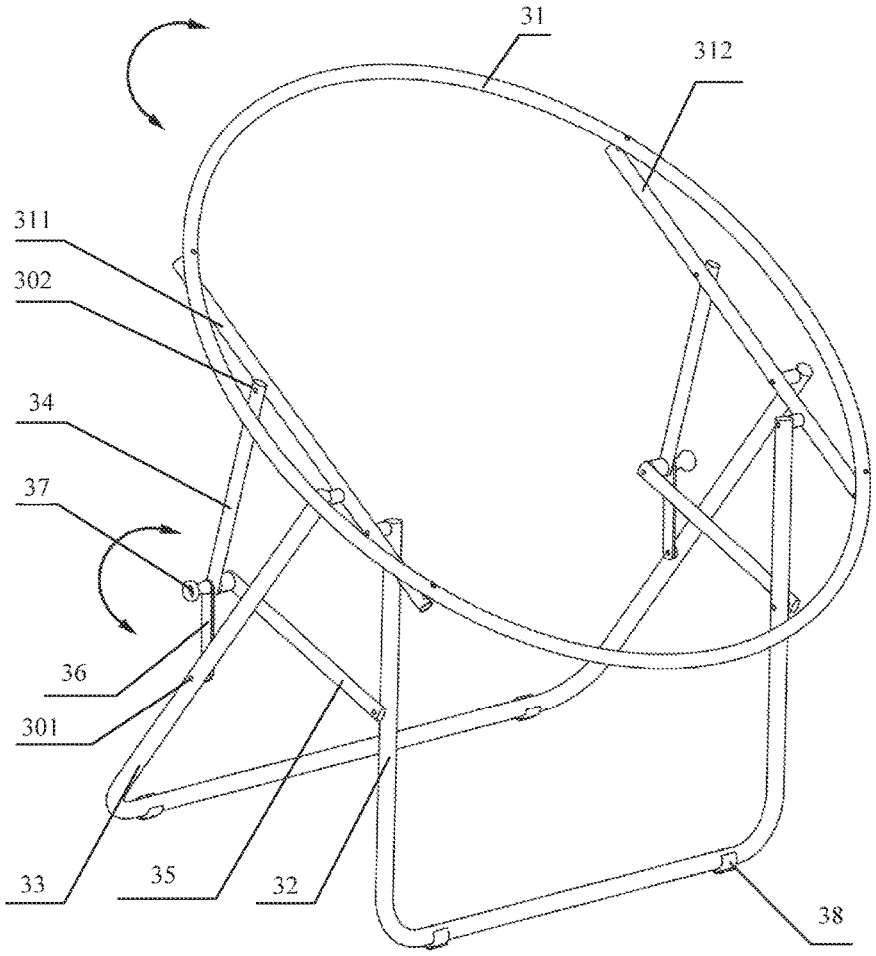
FIG. 5 is a schematic view showing the moon chair according to the second embodiment of the present application when the moon chair is partially folded.
Figure 6:
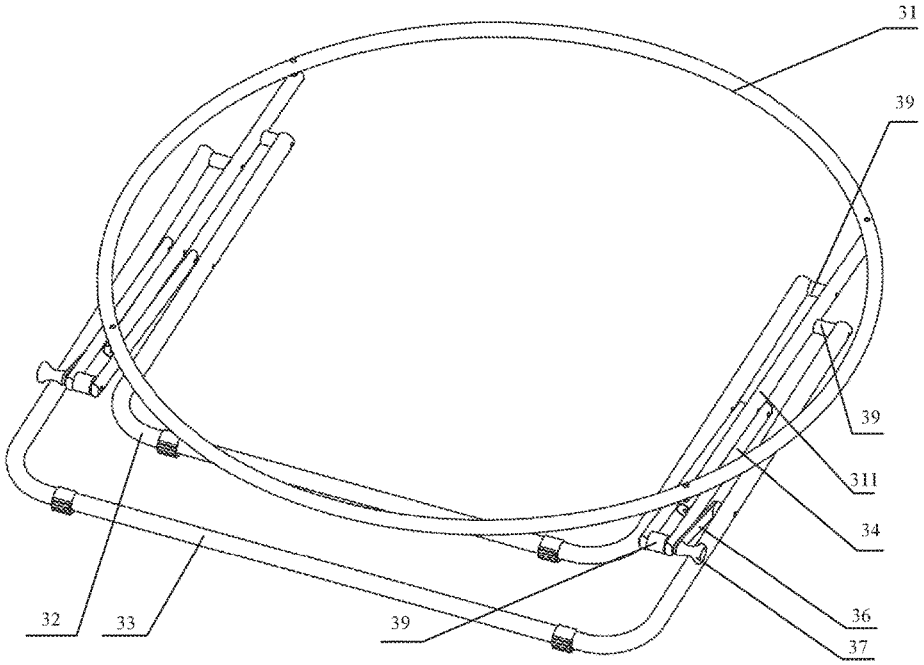
FIG. 6 is a schematic view showing the moon chair according to the second embodiment of the present application when the moon chair is completely folded.
Figure 7:
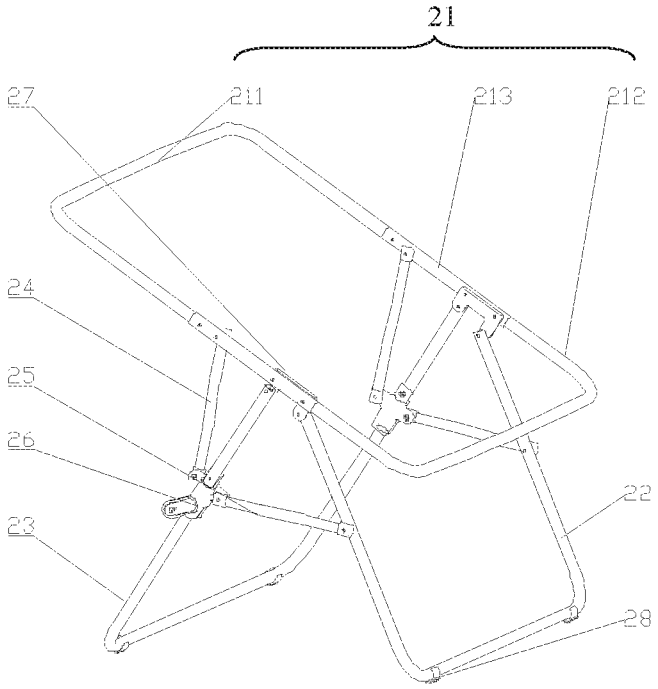
FIG. 7 is a schematic view showing a moon chair according to a third embodiment of the present application when the moon chair is unfolded.

| Reference Numerals in FIGS. 1 to 3: | | | |
|---|---|---|---|
| 11 | seat rod, | 111 | first seat rod, |
| 112 | second seat rod, | 113 | seat rod reinforcement tube, |
| 12 | front foot rod, | 13 | rear foot rod, |
| 14 | first supporting rod, | 15 | second supporting rod, |
| 16 | rotatable fixing member, | 17 | foot rod connection strap, |
| 18 | foot sleeve, | 101 | first articulated shaft, |
| 102 | second articulated shaft, | 103 | third articulated shaft. |
| Reference Numerals in FIGS. 4 to 6: | | | |
| 31 | seat rod, | 311 | first seat-rod supporting tube, |
| 312 | second seat-rod supporting tube, | 32 | front foot rod, |
| 33 | rear foot rod, | 34 | first supporting rod, |
| 35 | second supporting rod, | 36 | rotatable fixing member, |
| 37 | drum-shaped stopper, | 38 | foot sleeve, |
| 39 | spacer, | 301 | first articulated shaft, |
| 302 | second articulated shaft. | | |
| Reference Numerals in FIG. 7: | | | |
| 21 | seat rod, | 211 | first seat rod, |
| 212 | second seat rod, | 213 | seat rod reinforcement tube, |
| 22 | front foot rod, | 23 | rear foot rod, |
| 24 | first supporting rod, | 25 | second supporting rod, |
| 26 | slidable fixing member, | 27 | foot rod connection strap, |
| 28 | foot sleeve. | | |

DETAILED DESCRIPTION

For those skilled in the art to better understand technical solutions of the present application, the present application is further described in detail below in conjunction with drawings and embodiments.

First Embodiment

FIGS. 1 to 3 are schematic views respectively showing that a moon chair according to the first embodiment of the present application when the moon chair is unfolded, partially folded and completely folded. As shown in FIGS. 1 and 2, the moon chair according to the first embodiment includes a seat rod 11, a front foot rod 12, a rear foot rod 13, a first supporting rod 14, a second supporting rod 15 and a rotatable fixing member 16. The front foot rod 12 and the rear foot rod 13 are each articulated to the seat rod 11, a side of the rotatable fixing member 16 is provided with a clamping groove configured to clamp the rear foot rod 13 or the seat rod 11. The rotatable fixing member 16 has one end articulated to the rear foot rod 13 and is rotatable around a first articulated shaft 101 which is connected to the rear foot rod 13. Two ends of the first supporting rod 14 are respectively articulated to the seat rod 11 and the rotatable fixing member 16, and two ends of the second supporting rod 15 are respectively articulated to the front foot rod 12 and the rotatable fixing member 16. The rotatable fixing member 16 has two working states, including a first working state and a second working state. In the first working state, the rotatable fixing member 16 is rotated clockwise around the first articulated shaft 101 to allow the clamping groove to clamp the rear foot rod 13. In the second working state, the rotatable fixing member 16 is rotated anticlockwise around the first articulated shaft 101 to allow the clamping groove to clamp the seat rod 11.

In the case that the moon chair is unfolded, that is, the rotatable fixing member 16 is in the first working state, when a pressure is exerted on the seat rod 11 in a vertical direction, the front foot rod 12 tends to rotate forward (i.e. the anticlockwise direction in FIG. 1) and drives the second supporting rod 15 to move forward, thus driving the rotatable fixing member 16 to tightly clamp the rear foot rod 13. The second supporting rod 15 can ensure an opening angle between the front foot rod 12 and the rear foot rod 13 to reach a maximum value.

As shown in FIG. 1, when the rotatable fixing member 16 is in the first working state, the first articulated shaft 101 by which the rear foot rod 13 and the rotatable fixing member 16 are connected, a second articulated shaft 102 by which the rotatable fixing member 16 and the first supporting rod 14 are connected, and a third articulated shaft 103 by which the first supporting rod 14 and the seat rod 11 are connected are not in a straight line, and the second articulated shaft 102 is at a position close to the front foot rod 12, therefore the second articulated shaft 102 passes beyond a dead center of the crank structure. When a pressure is exerted on the seat rod 11, the pressure is transferred to the rotatable fixing member 16 by the first supporting rod 14, thus the rotatable fixing member 16 is tightly pressed against the rear foot rod 13.

Therefore, the stability of the whole moon chair in an unfolded state (as shown in FIG. 1) can be ensured by the combined action of the first supporting rod 14 and the second supporting rod 15. Of course, in other embodiments, the second articulated shaft 102 may also be in a line connecting the first articulated shaft 101 and the third articulated shaft 103. For example, when a person is seated on the moon chair, if a transverse force exerted on the rotatable fixing member 16 by the second supporting rod 15 is greater than a transverse force exerted on the rotatable fixing member 16 by the first supporting rod 14, the second articulated shaft 102 may also be in the line connecting the first articulated shaft 101 and the third articulated shaft 103 at a side away from the front foot rod 12.

When it is required to fold the moon chair, the rotatable fixing member 16 rotates around the first articulated shaft 101 anticlockwise to reach a position shown in FIG. 2. When the rotatable fixing member 16 continues to rotate, the rotatable fixing member 16 reaches the second working state, and the clamping groove clamps the seat rod 11. In this case, the moon chair has been folded and reaches the position shown in FIG. 3. In conclusion, during a process of folding the moon chair, an external force is exerted on the front foot rod 12 towards the rear foot rod 13, to drive the rotatable fixing member 16 to leave the first working state and rotate around the first articulated shaft 101 to finish the folding operation, and thus the operation is very convenient.

In this embodiment of the present application, the seat rod 11, the front foot rod 12, the rear foot rod 13, the first supporting rod 14 and the second supporting rod 15 are all circular hollow tubes, which can decrease the weight of the whole moon chair and decrease edges and corners on the whole moon chair to avoid collision injuries. Of course, in other embodiments, the above parts may also be made of solid tubes and the rods may also have various cross-sectional shapes.

In this embodiment of the present application, the first supporting rod 14 and the second supporting rod 15 are articulated to the rotatable fixing member 16 by the same articulated shaft that is the second articulated shaft 102. By using the same articulated shaft, the number of holes perforated on the rotatable fixing member 16 may be reduced, the strength of the rotatable fixing member 16 is improved and the structure of the rotatable fixing member 16 is simplified.

The seat rod 11 of the moon chair according to the embodiment of the present application may include a first seat rod 111, a second seat rod 112 and a seat rod reinforcement tube 113, and the seat rod reinforcement tube 113 is used to connect the first seat rod 111 to the second seat rod 112. It can be understood that, the seat rod 11 can be formed by one rod element, or formed by several rod elements connected by welding, clamping or sleeving. The front foot rod 12, the rear foot rod 13 and the first supporting rod 14 are all articulated to the seat rod reinforcement tube 113, to be connected to the seat rod 11. Of course, the front foot rod 12, the rear foot rod 13 and the first supporting rod 14 may also be connected to the first seat rod 111, the second seat rod 112 and the seat rod reinforcement tube 113, respectively. The seat rod 11 of the moon chair in the embodiment of the present application is of a rectangular shape, and may also have other shapes in other embodiments, such as a circular shape or other personalized shapes.

In this embodiment, the seat rod 11 is provided with a foot rod connection strap 17. The foot rod connection strap 17 is fixed on the seat rod reinforcement tube 113, and the rear foot rod 13 is articulated to the foot rod connection strap 17, to be connected to the seat rod 11. Therefore, in this case, when the rear foot rod 13 rotates, the plane of the rotation of two lateral rods connected to the seat rod 11 is coplanar with two lateral rods of the seat rod 11. The front foot rod 12 is arranged at an inner side of the seat rod 11, the first supporting rod 14 is arranged at an inner side of the seat rod 11 and an inner side of the rotatable fixing member 16, and the second supporting rod 15 is arranged at an inner side of the first supporting rod 14 and an inner side of the front foot rod 12. Therefore, during the process of folding the moon chair, the first supporting rod 14, the second supporting rod 15, the front foot rod 12 and the rear foot rod 13 will not interfere with each other, and after the moon chair is folded, the front foot rod 12, the first supporting rod 14 and the second supporting rod 15 are all located at the inner side of the seat rod 11 and the inner side of the rear foot rod 13. Of course, other stacked structures can also be used to connect the parts of the moon chair according to this embodiment, to facilitate folding the moon chair.

For forming a stable supporting plane on the ground, the bottoms of the front foot rod 12 and the rear foot rod 13 are each further provided with a foot sleeve 18 in this embodiment. Of course, in other embodiments, the front foot rod 12 and the rear foot rod 13 may directly touch the ground without the foot sleeve 18.

Second Embodiment

FIGS. 4 to 6 are schematic views respectively showing that a moon chair according to the second embodiment of the present application when the moon chair is unfolded, partially folded and completely folded. As shown in FIGS. 4 and 5, the moon chair according to the second embodiment includes a seat rod 31, a front foot rod 32, a rear foot rod 33, a first supporting rod 34, a second supporting rod 35 and a rotatable fixing member 36. The front foot rod 32 and the rear foot rod 33 are each articulated to the seat rod 31, the rotatable fixing member 36 has a first end articulated to the rear foot rod 33 and is rotatable around a first articulated shaft 301 which is connected to the rear foot rod 33, and has a second end provided with a drum-shaped stopper 37 configured to abut against the rear foot rod 33. Two ends of the first supporting rod 34 are respectively articulated to the seat rod 31 and the rotatable fixing member 36, and two ends of the second supporting rod 35 are respectively articulated to the front foot rod 32 and the rotatable fixing member 36. The rotatable fixing member 36 has two working states, including a first working state and a second working state. In the first working state, the rotatable fixing member 36 is rotated clockwise around the first articulated shaft 301 to allow the drum-shaped stopper 37 to abut against the rear foot rod 33 at a first position higher than the first articulated shaft 301. In the second working state, the rotatable fixing member 36 is rotated anticlockwise around the first articulated shaft 301 to allow the drum-shaped stopper 37 to abut against the rear foot rod 33 at a second position lower than the first articulated shaft 301.

As shown in FIGS. 4 to 6, the rotatable fixing member 36 is embodied as an elongated plate, and the first end of the rotatable fixing member 36 is articulated to the rear foot rod 33 at the inner side of the rear foot rod 33 via the first articulated shaft 301. The second end of the rotatable fixing member 36 is provided with a first through hole, the end of the first supporting rod 34 that is articulated to the rotatable fixing member 36 is provided with a second through hole, the end of the second supporting rod 35 that is articulated to the rotatable fixing member 36 is also provided with a third through hole. The drum-shaped stopper 37 has a drum-shaped portion and a rod portion, and the rod portion of the drum-shaped stopper 37 passes through the first through hole, the second through hole and the third through hole, and the rotatable fixing member 36, the first supporting rod 34 and the second supporting rod 35 are rotatable around the drum-shaped stopper 37, thus the first supporting rod 34 and the second supporting rod 35 are each articulated to the rotatable fixing member 36 via the drum-shaped stopper 37. The drum-shaped portion of the drum-shaped stopper 37 has a necked portion which is necked in the radial direction of the drum-shaped stopper 37, and when the drum-shaped stopper 37 is pressed against the rear foot rod 33, the necked portion cooperates with the outer surface of the rear foot rod 33 to limit the movement of the rear foot rod 33.

In the case that the moon chair is unfolded, that is, the rotatable fixing member 36 is in the first working state, when a pressure is exerted on the seat rod 31 in a vertical direction, the front foot rod 32 tends to rotate forward (i.e. the anticlockwise direction in FIG. 4) and drives the second supporting rod 35 to move forward, thus driving the drum-shaped stopper 37 at the second end of the rotatable fixing member 36 to tightly abut against the rear foot rod 33 at the first position. The second supporting rod 35 can ensure an opening angle between the front foot rod 32 and the rear foot rod 33 to reach a maximum value.

As shown in FIG. 4, when the rotatable fixing member 36 is in the first working state, the first articulated shaft 301 by which the rear foot rod 33 and the rotatable fixing member 36 are connected, the drum-shaped stopper 37 by which the rotatable fixing member 36 and the first supporting rod 34 are connected, and a second articulated shaft 302 by which the first supporting rod 34 and the seat rod 31 are connected are not in a straight line, and the drum-shaped stopper 37 is at a position close to the front foot rod 32, therefore the drum-shaped stopper 37 passes beyond a dead center of the crank structure. When a pressure is exerted on the seat rod 31, the pressure is transferred to the drum-shaped stopper 37 by the first supporting rod 34, thus the drum-shaped stopper 37 at the second end of the rotatable fixing member 36 is tightly pressed against the rear foot rod 33.

Therefore, the stability of the whole moon chair in an unfolded state (as shown in FIG. 4) can be ensured by the combined action of the first supporting rod 34 and the second supporting rod 35. Of course, in other embodiments, the drum-shaped stopper 37 may also be in a line connecting the first articulated shaft 301 and the second articulated shaft 302. For example, when a person is seated on the moon chair, if a transverse force exerted on the drum-shaped stopper 37 by the second supporting rod 35 is greater than a transverse force exerted on the drum-shaped stopper 37 by the first supporting rod 34, the drum-shaped stopper 37 may also be in the line connecting the first articulated shaft 301 and the second articulated shaft 302 at a side away from the front foot rod 32.

When it is required to fold the moon chair, the rotatable fixing member 36 rotates around the first articulated shaft 301 anticlockwise to reach a position shown in FIG. 5. When the rotatable fixing member 36 continues to rotate, the rotatable fixing member 36 reaches the second working state, and the drum-shaped stopper 37 at the second end of the rotatable fixing member 36 abuts against the rear foot rod 33 at the second position. In this case, the moon chair has been folded and reaches the position shown in FIG. 6. In conclusion, during a process of folding the moon chair, an external force is exerted on the front foot rod 32 towards the rear foot rod 33, to drive the rotatable fixing member 36 to leave the first working state and rotate around the first articulated shaft 301 to finish the folding operation, and thus the operation is very convenient.

In this embodiment of the present application, the seat rod 31, the front foot rod 32, the rear foot rod 33, the first supporting rod 34 and the second supporting rod 35 are all circular hollow tubes, which can decrease the weight of the whole moon chair and decrease edges and corners on the whole moon chair to avoid collision injuries. Of course, in other embodiments, the above parts may also be made of solid tubes and the rods may also have various cross-sectional shapes.

In this embodiment of the present application, the first supporting rod 34 and the second supporting rod 35 are articulated to the rotatable fixing member 36 by the same member that is the drum-shaped stopper 37. By using the same member, the number of holes perforated on the rotatable fixing member 36 may be reduced, the strength of the rotatable fixing member 36 is improved and the structure of the rotatable fixing member 36 is simplified.

The seat rod 31 of the moon chair according to the embodiments of the present application may have various shapes, for example the rectangular shape shown in FIGS. 1 to 3 and 7, or the circular shape shown in FIGS. 4 to 6, and the shape of the seat rod 31 is not limited to the above described shapes.

The seat rod 31 is described hereinafter by taking the circular shape in FIGS. 4 to 6 as an example, a first seat-rod supporting tube 311 and a second seat-rod supporting tube 312 are symmetrically fixed below the circular seat rod 31 at two sides of the circular seat rod 31. Two ends of the first seat-rod supporting tube 311 at the left side of the circular seat rod 31 are fixed to the circular seat rod 31, by screws or bolts; and two ends of the second seat-rod supporting tube 312 at the right side of the circular seat rod 31 are fixed to the circular seat rod 31, by screws or bolts. The first seat-rod supporting tube 311 and the second seat-rod supporting tube 312 are configured to connect the front foot rod 32 and the rear foot rod 33.

The connection relationship between the front foot rod 32, the rear foot rod 33 and the first and second seat-rod supporting tubes 311 and 312 is described by taking the first seat-rod supporting tube 311 at the left side as an example. The front foot rod 32 is articulated to the first seat-rod supporting tube 311 at the inner side of the first seat-rod supporting tube 311, and a spacer 39 is arranged between the articulated ends of the front foot rod 32 and the first seat-rod supporting tube 311; and the rear foot rod 33 is articulated to the first seat-rod supporting tube 311 at the outer side of the first seat-rod supporting tube 311, and a spacer 39 is also arranged between the articulated ends of the rear foot rod 33 and the first seat-rod supporting tube 311. In addition, a spacer 39 may be further arranged between the articulated ends of the first supporting rod 34 and the second supporting rod 35, that is, the rod portion of the drum-shaped stopper 37 also passes though the spacer 39. With the arrangement of the spacers 39, during the process of folding the moon chair, the first supporting rod 34, the second supporting rod 35, the front foot rod 32, the rear foot rod 33 and the first seat-rod supporting tube 311 will not interfere with each other. And when the moon chair is folded, as shown in FIG. 6, the rear foot rod 33, the first seat-rod supporting tube 311 and the front foot rod 32 are in parallel with each other, thus the thickness of the folded moon chair is further reduced, and the moon chair according to this embodiment has a small package size, which also reduces the package cost.

For forming a stable supporting plane on the ground, the bottoms of the front foot rod 32 and the rear foot rod 33 are each further provided with a foot sleeve 38 in this embodiment. Of course, in other embodiments, the front foot rod 32 and the rear foot rod 33 may directly touch the ground without the foot sleeve 38.

Third Embodiment

FIG. 7 is a schematic view showing a moon chair according to a third embodiment of the present application when the moon chair is unfolded. As shown in FIG. 7, the whole structure of the moon chair presenting this embodiment is similar to the structure of the moon chair in the first embodiment, and the differences between the two embodiments are described in detail below.

The moon chair in this embodiment employs a slidable fixing member 26. The slidable fixing member 26 includes a pin and a main body sleeved on a rear foot rod 23. The main body is provided with a through hole, the rear foot rod 23 includes a first fixing position and a second fixing position, and the rear foot rod 23 is provided with through holes respectively at the first fixing position and the second fixing position. In a first working state, the pin passes through the through hole in the main body and the through hole at the first fixing position of the rear foot rod 23, to fix the slidable fixing member 26 at the first fixing position, and in a second working state, the pin passes through the through hole in the main body and the through hole at the second fixing position of the rear foot rod 23, to fix the slidable fixing member 26 at the second fixing position. When the pin is at the first fixing position, the moon chair is unfolded. When the pin is in the second fixing position, the moon chair is folded. It can be understood that, in this embodiment, the rear foot rod 23 may be provided with multiple first fixing positions, to provide various choices for the opening height of the moon chair and the opening angle between a front foot rod 22 and the rear foot rod 23, to adapt to various application environments. It should be noted that, since this embodiment employs the pin to fix the slidable fixing member 26, there is no need to consider the dead center.

In this embodiment, the pin may be a spring pin. A pin shaft of the spring pin may be pulled outwards to allow the slidable fixing member 26 to be switched between the first working state and the second working state, and after the switching of the working states is realized, the pin shaft of the spring pin can automatically retract into the through hole in the respective fixing position. Of course, ordinary pins may also be used in other embodiments.

By using the slidable fixing member 26, a first supporting rod 24 and a second supporting rod 25 are respectively arranged at two sides of the slidable fixing member 26 and the rear foot rod 23, thus two sides of the main body of the slidable fixing member 26 in this embodiment are respectively provided with articulated shafts respectively connected to the first supporting rod 24 and the second supporting rod 25. Furthermore, unlike the first embodiment, a foot rod connection strap 27 employed in this embodiment is articulated to both the front foot rod 22 and the rear foot rod 23.

The moon chair according to the embodiments of the present application is described in detail hereinbefore. The principle and the embodiments of the present application are illustrated herein by specific examples. The above description of examples is only intended to help the understanding of the technical solution of the present application. It should be noted that, for the person skilled in the art, a few of modifications and improvements may be made to the present application without departing from the principle of the present application, and these modifications and improvements are also deemed to fall into the scope of the present application defined by the claims.

What is claimed is:

1. A moon chair, comprising a seat rod, a front foot rod and a rear foot rod; the seat rod being configured to be covered by fabric to define a seat and a backrest, and the front foot rod and the rear foot rod being respectively articulated to the seat rod;

wherein the moon chair further comprises a first supporting rod, a second supporting rod and a fixing member installed on the rear foot rod;

the first supporting rod is articulated to the seat rod and the fixing member;

the second supporting rod is articulated to the front foot rod and the fixing member;

the fixing member has a first working state and a second working state;

in the case that the fixing member is in the first working state, the moon chair is in an unfolded state; and in the case that the fixing member is in the second working state, the moon chair is in a folded state.

2. The moon chair according to claim 1, wherein the fixing member is a rotatable fixing member;

the rotatable fixing member has one end articulated to the rear foot rod and another end articulated to the first supporting rod and the second supporting rod;

one side of the rotatable fixing member is provided with a clamping groove;

in the case that the rotatable fixing member is in the first working state and the moon chair is in the unfolded state, the clamping groove is configured to clamp the rear foot rod; and in the case that the rotatable fixing member is in the second working state and the moon chair is in the folded condition, the clamping groove is configured to clamp the seat rod.

3. The moon chair according to claim 2, wherein the rotatable fixing member is articulated to the rear foot rod by a first articulated shaft;

the rotatable fixing member is articulated to the first supporting rod by a second articulated shaft;

the first supporting rod is articulated to the seat rod by a third articulated shaft; and the second articulated shaft is located in a connecting line connecting the first articulated shaft and the third articulated shaft at a side close to the front foot rod, or the second articulated shaft is located in the connecting line.

4. The moon chair according to claim 1, wherein the fixing member is a rotatable fixing member;

the rotatable fixing member has a first end articulated to the rear foot rod by a first articulated shaft and a second end articulated to the first supporting rod and the second supporting rod via a drum-shaped stopper;

in the case that the rotatable fixing member is in the first working state and the moon chair is in the unfolded state, the drum-shaped stopper is configured to abut against the rear foot rod at a first position higher than the first articulated shaft; and in the case that the rotatable fixing member is in the second working state and the moon chair is in the folded condition, the drum-shaped stopper is configured to abut against the rear foot rod at a second position lower than the first articulated shaft.

5. The moon chair according to claim 4, wherein the drum-shaped stopper has a drum-shaped portion and a rod portion, the rod portion of the drum-shaped stopper is configured to pass through respective through holes in the second end of the rotatable fixing member, the first supporting rod and the second supporting rod, to allow the first supporting rod and the second supporting rod to be articulated to the rotatable fixing member; and the drum-shaped portion has a necked portion which is necked in the radial direction of the drum-shaped stopper and configured to cooperate with an outer surface of the rear foot rod.

6. The moon chair according to claim 5, wherein the first supporting rod is articulated to the seat rod by a second articulated shaft; and the drum-shaped stopper, by which the rotatable fixing member is articulated to the first supporting rod, is located in a connecting line connecting the first articulated shaft and the second articulated shaft at a side close to the front foot rod, or the drum-shaped stopper is located in the connecting line.

7. The moon chair according to claim 5, wherein a first seat-rod supporting tube and a second seat-rod supporting tube respectively configured to connect the front foot rod and the rear foot rod are symmetrically fixed below the seat rod at two sides of the seat rod, two ends of the first seat-rod supporting tube at a left side of the seat rod are fixed to the seat rod; and two ends of the second seat-rod supporting tube at a right side of the seat rod are fixed to the seat rod; the front foot rod is articulated to each of the first seat-rod supporting tube and the second seat-rod supporting tube at an inner side of the respective seat-rod supporting tube, and a first spacer is arranged between articulated ends of the front foot rod and the respective seat-rod supporting tube; the rear foot rod is articulated to each of the first seat-rod supporting tube and the second seat-rod supporting tube at an outer side of the respective seat-rod supporting tube, and a second spacer is arranged between articulated ends of the rear foot rod and the respective seat-rod supporting tube; and a third spacer is arranged between articulated ends of the first supporting rod and the second supporting rod.

8. The moon chair according to claim 1, wherein the fixing member is a slidable fixing member;

the slidable fixing member comprises a main body and a pin;

the main body is sleeved on the rear foot rod;

the rear foot rod has a first fixing position and a second fixing position for fixing the slidable fixing member; and the main body is configured to be fixed at the first fixing position or the second fixing position by the pin.

9. The moon chair according to claim 8, wherein in the case that the slidable fixing member is in the first working state and the moon chair is in the unfolded state, the main body is configured to be fixed at the first fixing position by the pin; and in the case that the slidable fixing member is in the second working state and the moon chair is in the folded condition, the main body is configured to be fixed at the second fixing position by the pin.

10. The moon chair according to claim 8, wherein the pin is a spring pin.

11. The moon chair according to claim 10, wherein the rear foot rod is provided with a plurality of the first fixing positions.

12. The moon chair according to claim 1, wherein the seat rod comprises a first seat rod, a second seat rod and a seat rod reinforcement tube, and the first seat rod and the second seat rod are connected by the seat rod reinforcement tube.

13. The moon chair according to claim 1, wherein the seat rod comprises a foot rod connection strap, and the foot rod connection strap is articulated to the front foot rod and/or the rear foot rod.

14. The moon chair according to claim 1, a bottom of the front foot rod and a bottom of the rear foot rod are each further provided with a foot sleeve.

15. The moon chair according to claim 2, wherein the seat rod comprises a first seat rod, a second seat rod and a seat rod reinforcement tube, and the first seat rod and the second seat rod are connected by the seat rod reinforcement tube.

16. The moon chair according to claim 2, wherein the seat rod comprises a foot rod connection strap, and the foot rod connection strap is articulated to the front foot rod and/or the rear foot rod.

17. The moon chair according to claim 3, wherein the seat rod comprises a first seat rod, a second seat rod and a seat rod reinforcement tube, and the first seat rod and the second seat rod are connected by the seat rod reinforcement tube.

18. The moon chair according to claim 3, wherein the seat rod comprises a foot rod connection strap, and the foot rod connection strap is articulated to the front foot rod and/or the rear foot rod.

19. The moon chair according to claim 8, wherein the seat rod comprises a first seat rod, a second seat rod and a seat rod reinforcement tube, and the first seat rod and the second seat rod are connected by the seat rod reinforcement tube.

20. The moon chair according to claim 8, wherein the seat rod comprises a foot rod connection strap, and the foot rod connection strap is articulated to the front foot rod and/or the rear foot rod.

* * * * *